US006546575B2

(12) United States Patent
DeAngelo

(10) Patent No.: US 6,546,575 B2
(45) Date of Patent: Apr. 15, 2003

(54) INFANT SLEEPER

(76) Inventor: Ilene DeAngelo, 246 LaGrange St., West Roxbury, MA (US) 02132

( * ) Notice: Subject to any disclaimer, the term of this patent is extended or adjusted under 35 U.S.C. 154(b) by 0 days.

(21) Appl. No.: 09/779,230

(22) Filed: Feb. 8, 2001

(65) Prior Publication Data

US 2001/0044958 A1 Nov. 29, 2001

Related U.S. Application Data

(60) Provisional application No. 60/182,008, filed on Feb. 11, 2000.

(51) Int. Cl.[7] ..... A47D 7/04
(52) U.S. Cl. ..... 5/95; 5/93.2; 5/603; 5/655
(58) Field of Search ..... 5/93.2, 95, 507.1, 5/93.1, 303.1, 658, 603, 655, 424, 2.1

(56) References Cited

U.S. PATENT DOCUMENTS

| | | | | | |
|---|---|---|---|---|---|
| 534,258 | A | * | 2/1895 | Froelich | 5/312 |
| 874,421 | A | * | 12/1907 | Nail | 5/104 |
| 2,537,539 | A | * | 1/1951 | McLendon et al. | 5/95 |
| 5,148,561 | A | | 9/1992 | Tharalson et al. | |
| 5,293,655 | A | | 3/1994 | VanWinkle et al. | |
| 5,430,899 | A | | 7/1995 | Chisholm | |
| 5,604,941 | A | | 2/1997 | Román | |
| 5,819,340 | A | | 10/1998 | Kelly | |

FOREIGN PATENT DOCUMENTS

| | | | | |
|---|---|---|---|---|
| DE | 2739358 | * | 8/1978 | 5/95 |
| DE | 2818189 | * | 6/1979 | 5/655 |

* cited by examiner

*Primary Examiner*—Michael F. Trettel
(74) *Attorney, Agent, or Firm*—Daly, Crowley & Mofford, LLP.

(57) ABSTRACT

An infant bed is slidably attachable to a bed frame such that the infant bed can be moved along a length of the bed frame. The infant bed can be readily moved in relation to the bed to maintain infant/adult closeness and facilitate adult ingress/egress from the adult bed.

11 Claims, 6 Drawing Sheets

INFANT SLEEPER

CROSS REFERENCE TO RELATED APPLICATIONS

This application claims the benefit of U.S. Provisional Patent Application No. 60/182,008, filed on Feb. 11, 2000.

FIELD OF THE INVENTION

The invention relates generally to infant equipment and, more particularly, to infant beds for coupling to an adult bed.

BACKGROUND OF THE INVENTION

It is well known that there are advantages to having a newborn sleep in proximity to its mother. For example, when the infant is close by, a mother can easily nurse the infant as well as take care of other needs. Close proximity is also a significant benefit for mothers who have undergone a Cesarean section. In addition, research has shown that newborns rely on proximity to their mothers to regulate body heat, breathing, and cardiac rhythms.

While there have been attempts to provide proximity and convenience to a mother and her infant, known devices, such as bassinets, do not provide the level of closeness that is desirable for many new mothers. Further, conventional devices that attach to a bed can be cumbersome and render it difficult for a mother to get on and off the bed.

It would therefore, be desirable to provide an infant bed that is slidably engageable to a bed frame for allowing an adult to be close to an infant to easily get on and off the adult bed.

SUMMARY OF THE INVENTION

The present invention provides an infant bed that is positionable alongside an adult bed to which the infant bed is secured. Although the invention is primarily shown and described with reference to a hospital-type bed, it is understood that the infant bed scan be coupled to a variety of beds having a frame that can support the infant bed alongside thereof.

In one aspect of the invention, an infant bed has a top portion and a bottom portion, which can be secured to an adult bed frame. Barriers upwardly extend from the top portion to form an interior region for confining an infant. A coupling mechanism, such as mounting rods extending from the bottom portion of the infant bed, secures the infant bed to the adult bed. In one embodiment, the mounting rods are received by corresponding structural members rigidly extending from the frame of the adult bed. The infant bed further includes a slidable bracket mechanism coupled to the bottom portion of the infant bed for allowing the infant bed to be moved along a length of the adult bed.

In a further aspect of the invention, a method for maintaining proximity between an infant and an adult includes placing a baby into an infant bed that is movable alongside a length of an adult bed. The infant bed is movable between first and second positions that provide closeness to the infant and facilitate egress from the adult/infant bed assembly. In one embodiment, a coupling mechanism secures a bottom portion of the infant bed to the adult bed and a slidable bracket mechanism enables longitudinal movement of the infant bed with respect to the adult bed.

BRIEF DESCRIPTION OF THE DRAWINGS

The invention will be more fully understood from the following detailed description taken in conjunction with the accompanying drawings, in which.

DETAILED DESCRIPTION OF THE INVENTION

Figure 1:
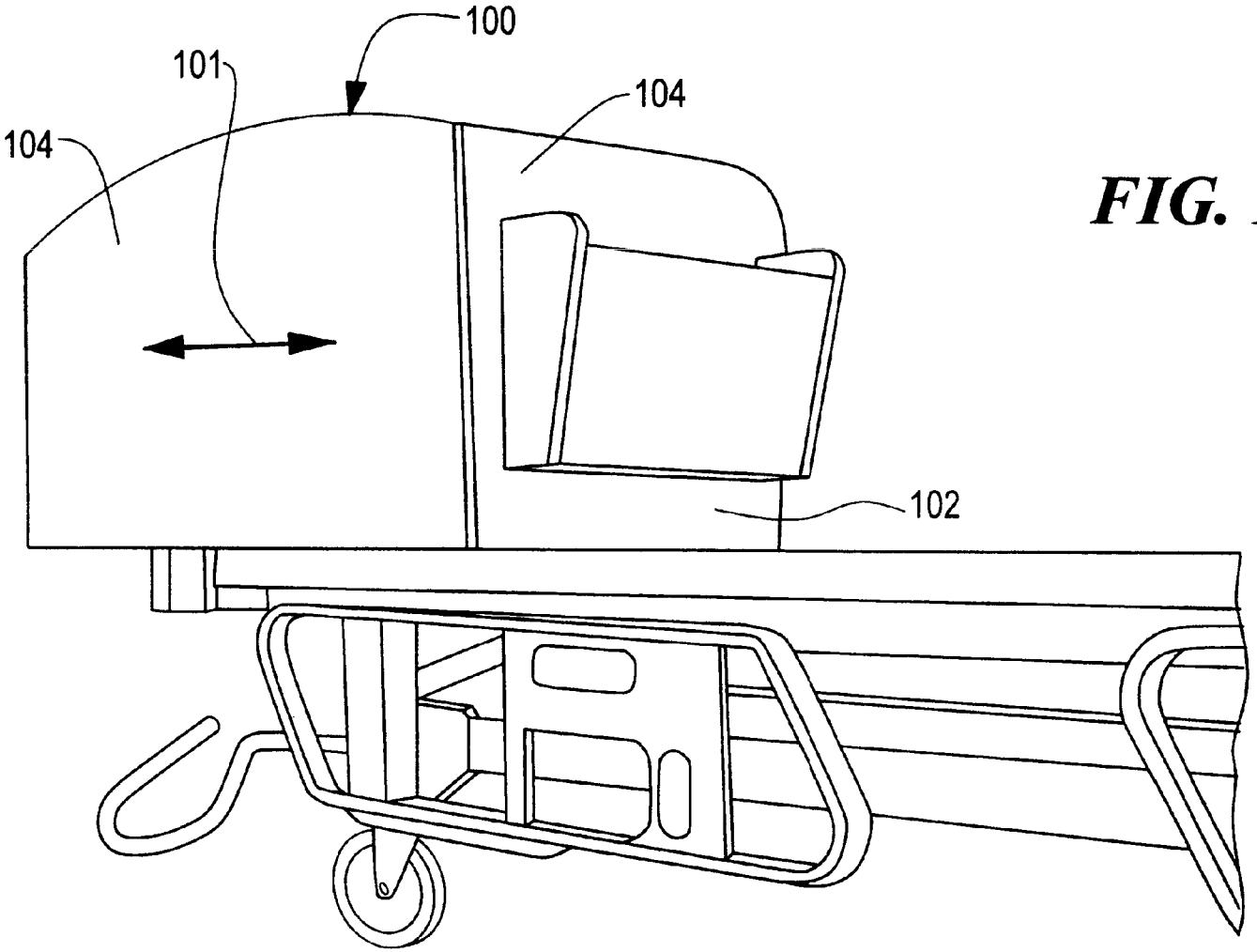
FIG. 1 is a pictorial representation of an infant bed that is movable alongside an adult bed in accordance with the present invention.

FIG. 1 shows an exemplary embodiment of an infant bed 100 in accordance with the present invention. The infant bed can be secured to an adult bed and adjusted to a desired position along the length of a bed as indicated by arrow 101. Thus, an adult can move the infant bed 100 to facilitate getting on and off the bed, while maintaining a desired level of proximity with a newborn in the infant bed.

The infant bed 100 includes a flat bottom 102 from which four barriers 104 upwardly extend to confine an infant within the interior. It is understood that the barriers can comprise a variety of configurations that are suitable to keep an infant within the infant bed. Exemplary barriers include solid walls, railed fences and slotted barricades. It is further understood that the infant bed interior can have different geometric configurations including square, rectangular, circular, ovular and polygonal.

Figure 2:
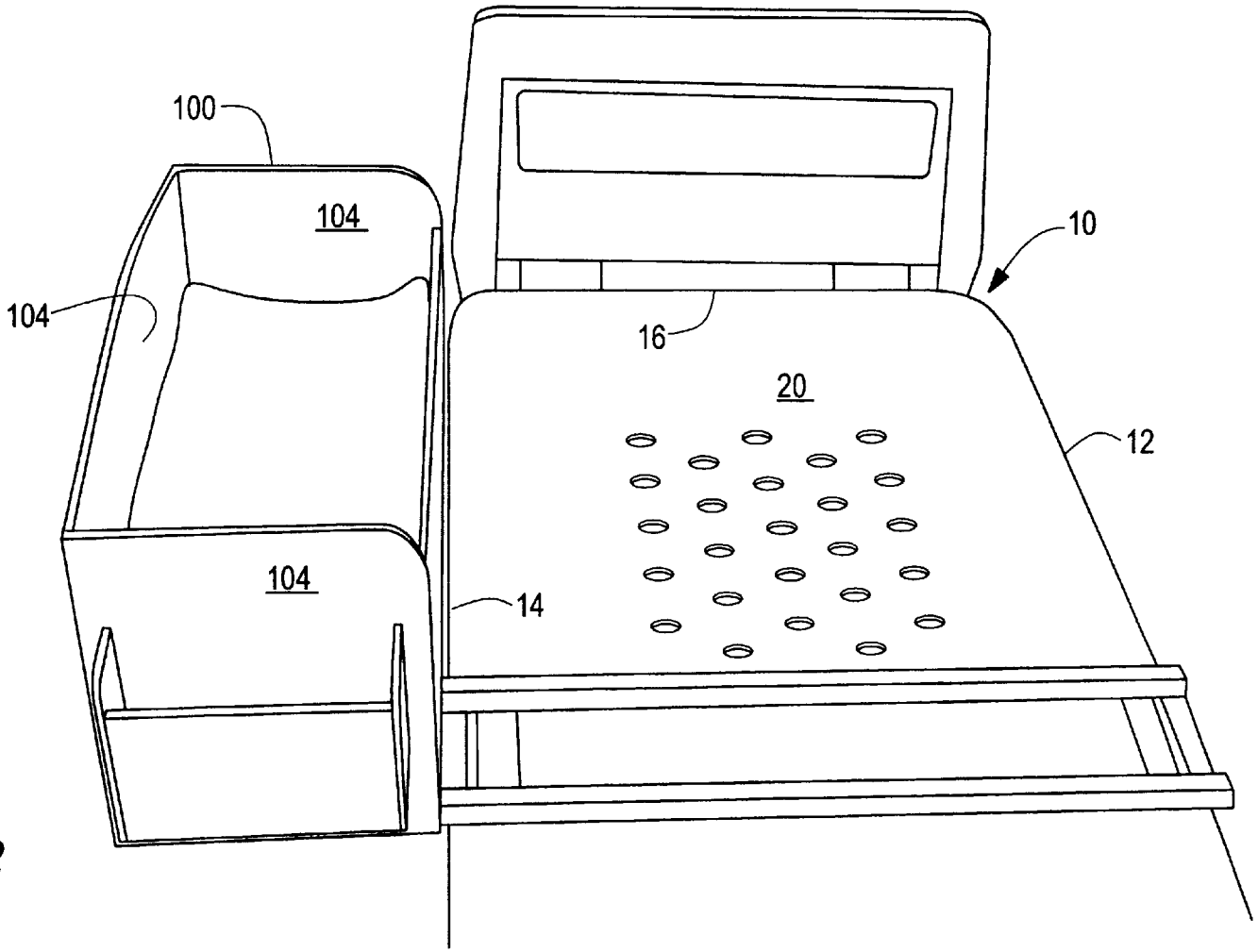
FIG. 2 is a perspective view showing further details of the infant bed of FIG. 1.

As shown in FIG. 2, the infant bed 100 is engageable to a bed frame 10, such as the frame of a hospital bed. The infant bed 100 is well-suited for use with a wide variety of bed frames generally having frame members for supporting a mattress and/or boxspring. The bed frame 10 can include a first pair of opposed frame members 12,14 for supporting a mattress along its length and a second pair of opposed frame members 16,(not shown) located at the head and foot of the bed frame for supporting the mattress along its width. The bed frame can further include a flat support member 20 that provides a flat surface adapted to support the underside of the mattress.

Figure 3:
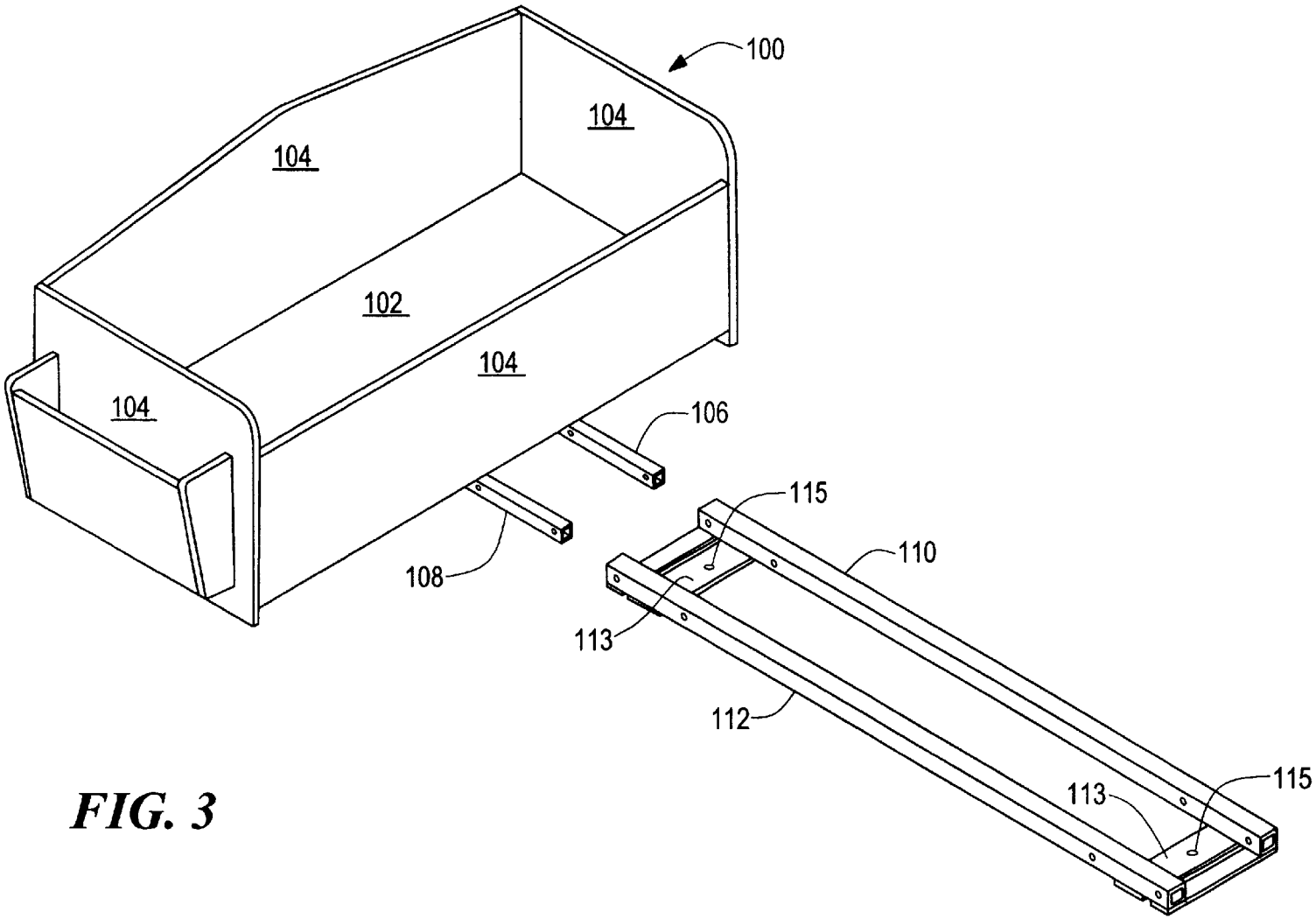
FIG. 3 is a perspective view of a mechanism for engaging the infant bed of FIG. 1 to a hospital bed.

FIG. 3 shows an exemplary mechanism for coupling the infant bed to the hospital bed frame. The coupling mechanism includes first and second mounting rods 106,108 rigidly extending from a base of the infant bed. In one embodiment, the rods 106,108 are fixedly coupled to a bottom portion of the infant bed base, as described below, to allow the infant bed to move along a length of the mother's bed. The rods 106,108 are insertable within corresponding first and second structural members 110,112 that are securable to the bed frame. The rods can be secured to the structural members using suitable permanent and removable devices including, nuts, bolts, rivets, interference fits, adhesives, welds, lock nuts and pins. In an illustrative embodiment, removable locking pins are used to secure the rods to the structural members. The pins prevent the infant bed from unintentional disengagement from the bed frame while allowing a user to remove the infant bed when desired.

The structural members 110,112 can be affixed to the bed frame using nut, bolt and washer assemblies to secure the members to the frame. In one embodiment, cross members 113 affixed to ends of the structural members are bolted to the bed frame, such as to the support member 20, in at least one location 115.

The position of the infant bed 100 can be adjusted along the length of the hospital bed as shown by the bidirectional arrow 110 shown in FIG. 1. In one embodiment, the infant bed is slidable with respect to the rods 106,108, which are secured to a bottom portion of the infant bed base. A variety of suitable mechanisms can be used to allow the infant bed 100 to slide along the length of the bed. Exemplary mechanisms include brackets, rods, and channels.

Figure 4:
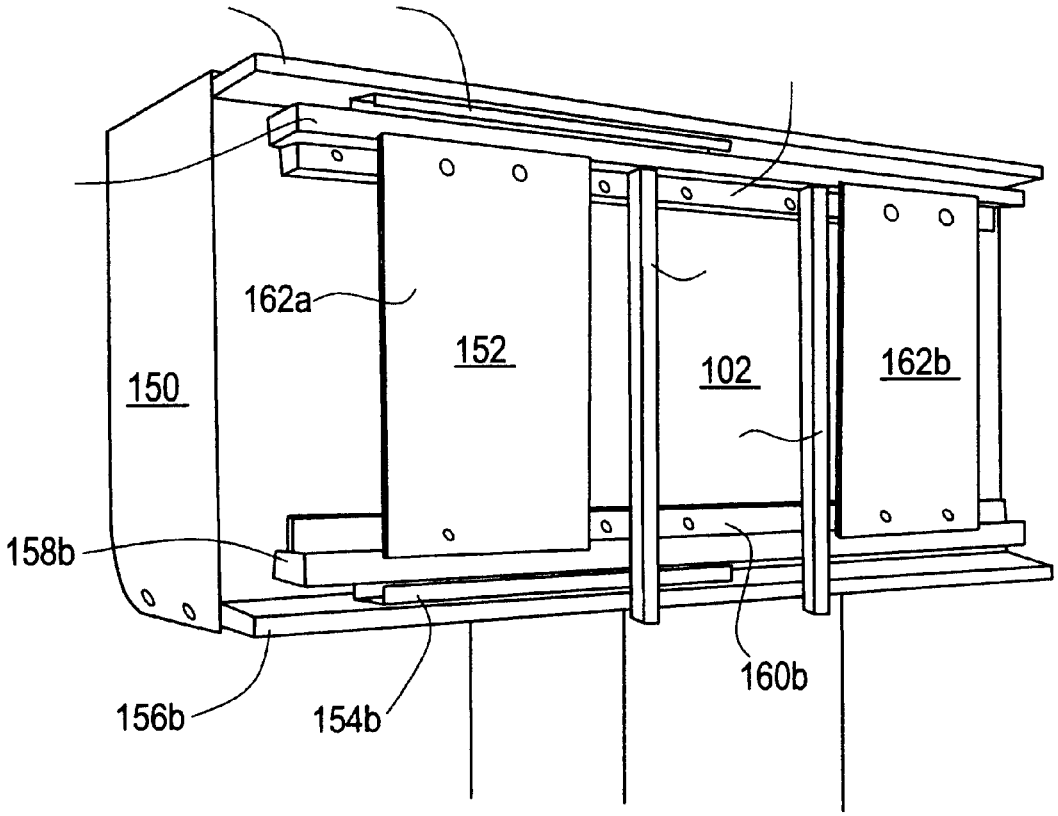
FIG. 4 is a bottom perspective view of the infant bed of FIG. 1.

FIG. 4 (bottom view) shows an exemplary arrangement for allowing the infant bed to slide to a desired location alongside the adult sized bed. The base 102 of the infant bed includes a top portion 150 that is movable with respect to a bottom portion 152 to which the rods 106,108 are secured. The base further includes sliding bracket mechanisms 154*a,b* that allow the base top portion 150 to move while the base bottom portion 152 remains in a fixed position relative to the bed frame.

In one embodiment, opposed first and second base extension members 156*a,b* rigidly extend from bottom edges of the flat bottom of the infant bed. A first inner base member 158*a* is secured to the bottom portion 152 of the base in spaced opposition to the first base extension member 156*a*, such the outer and inner base members form a channel. The bottom portion of the base, which is fixed relative to the bed frame, includes opposed structural members 160*a,b*, to which the outwardly extending mounting rods 106,108 are secured. In one embodiment, the first inner base member 158*a* is connected to the structural members of the base bottom portion. Similarly, the second inner base member 158*b*, which is affixed to the structural members 160, is disposed in spaced opposition to the second base extension member 156*b* so as to form a channel. The bottom portion of the base can further include cross members 162*a,b* for increasing the overall structural integrity of the device.

Figure 5:
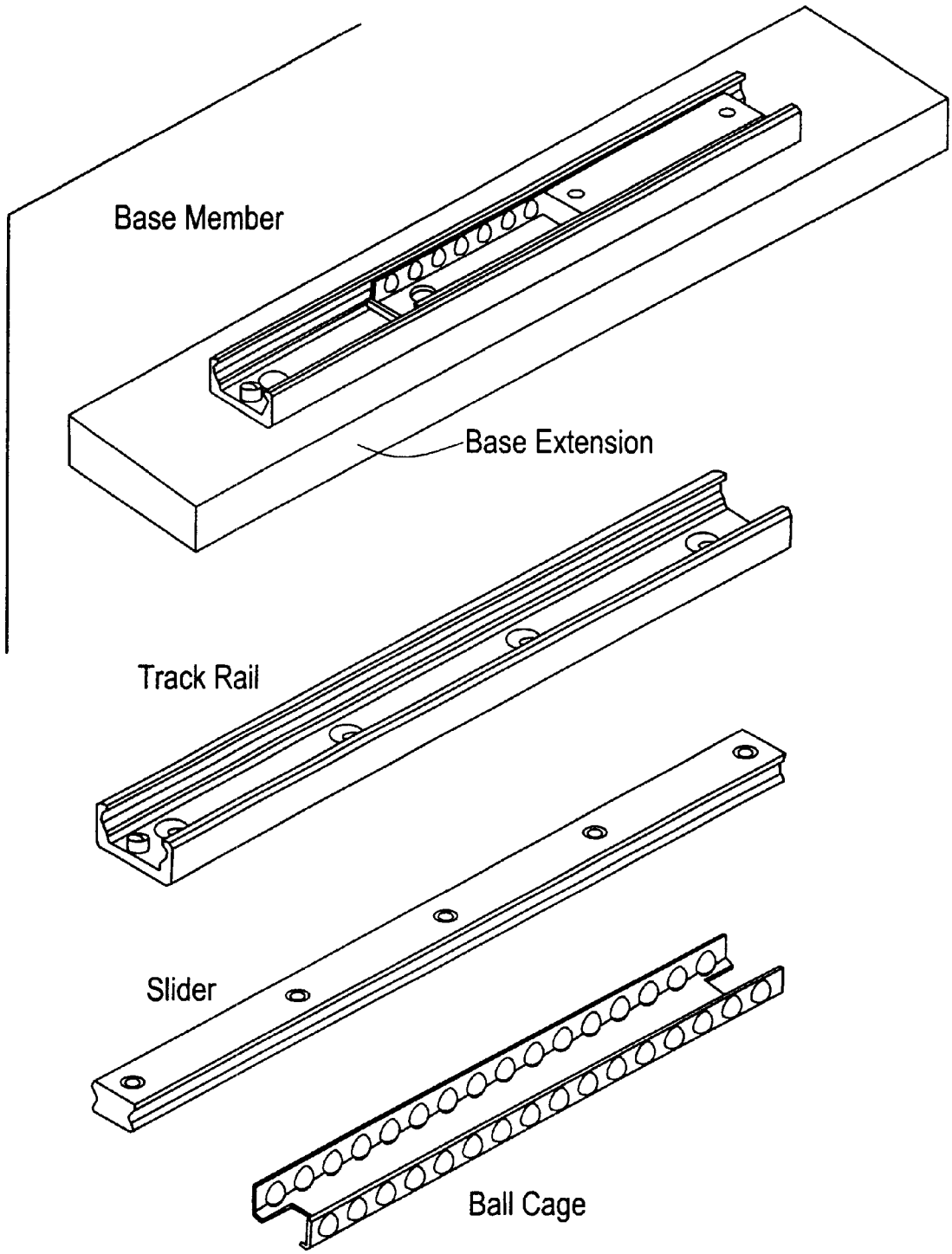
FIG. 5 is a perspective view of an exemplary sliding bracket mechanism that forms a part of the infant bed of FIG. 1.

The first bracket mechanism 154*a* is adapted for operating in the first channel formed by the first base extension member and the first inner base member. The second bracket mechanism 154*b* is adapted for operating in the second channel formed by second base extension member and the second inner base member. Each bracket mechanism includes first and second track-rail/slider assemblies for coupling to the base extension members. An exemplary track-rail sliding bracket mechanism is identified as Part No. S28T-120/540, which is shown in FIG. 5, available from Rollon Corporation of New Jersey and web site www.rollon.com.

The track-rail of the first bracket mechanism 154*a* is secured to an inner surface of the first base extension member (top portion of base) 156*a* and the corresponding slider is secured to a corresponding surface of the inner base member (bottom portion of base) 158*a*. Similarly, the track-rail and slider of the second bracket mechanism 154*b* are coupled to the respective second base extension member 156*b* and the second inner base member 158*b*. The sliders are easily displaceable within the track by means of a ball bearing cage. The slidable bracket mechanisms are disposed within the first and second channels to allow the top portion of the base to slide with respect to the bottom portion of the base. This arrangement allows the infant bed to be slidably positioned alongside the bedframe.

Figure 6:
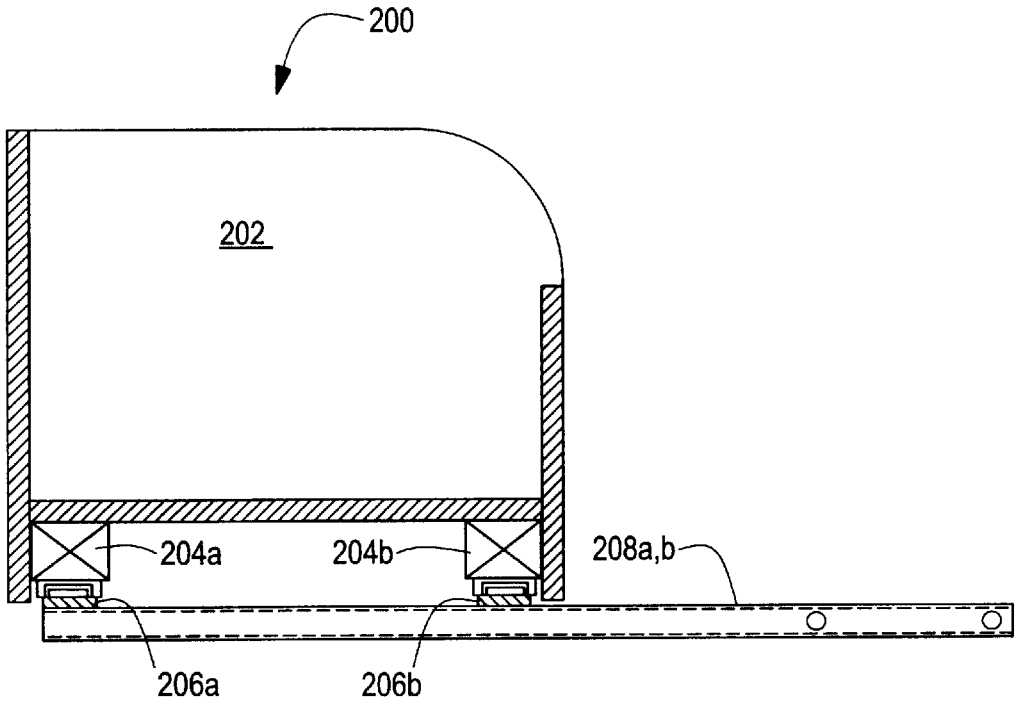
FIG. 6 is a cross-sectional view of a further embodiment of an infant bed in accordance with the present invention.
Figure 7:
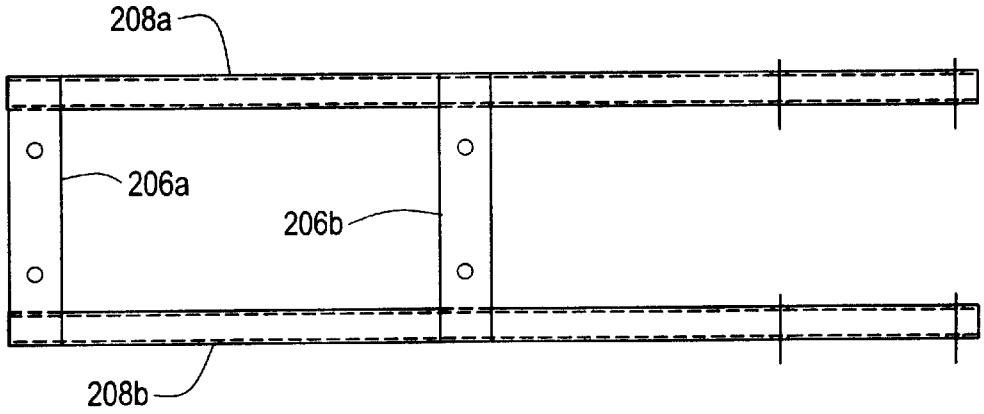
FIG. 7 is a top view of a portion of the infant bed of FIG. 6.

FIG. 6–7 show an alternative embodiment of an infant bed 200 that is movable alongside an adult bed (not shown) in accordance with the present invention. The infant bed includes a top portion 202 having a area for containing an infant and a bottom portion 204. In one embodiment, the bottom portion 204 of the infant bed includes opposed first and second members 204*a,b* secured to the top portion 202.

The first and second members 204 of the infant bed bottom portion are secured to respective first and second slidable bracket mechanisms 206*a,b*, which are also secured to a coupling mechanism, shown as a pair of rigid mounting rods 208*a,b*. The mounting rods 208 can be secured to structural members (not shown) extending from the adult bed. The opposed first and second slidable bracket mechanisms 204*a,b* enable the infant bed to move alongside the adult bed.

In another feature of the invention, the base includes a locking mechanism for securing the infant bed in position along its length of travel. The locking mechanism allows a user to affix the infant bed in a position after it has been moved to a desired position alongside the bed. Exemplary locking mechanisms include pins, bolts, interlocking surface features, and interference devices.

It is understood that various modifications and substitutions can be made to the embodiments described herein without departing from the present invention. For example, the type and number of devices corresponding to the slidable bracket mechanisms can be readily modified by one of ordinary skill in the art. In addition, a wide variety of devices known to one of ordinary skill in the art can be used for the coupling mechanism securing the infant bed to a bed frame. It is understood that further changes from the particular embodiments shown and described herein will be readily apparent.

One skilled in the art will appreciate further features and advantages of the invention based on the above-described embodiments. Accordingly, the invention is not to be limited by what has been particularly shown and described, except as indicated by the appended claims. All publications and references cited herein are expressly incorporated herein by reference in their entirety.

What is claimed is:

1. An infant bed for slidable engagement to a bed frame, comprising:

a bottom portion;

a top portion disposed over the bottom portion having upwardly extending barriers to form an interior region for confining an infant; and a coupling mechanism affixed to the bottom portion for securing the infant bed to the bed frame; and a slidable bracket mechanism coupled to the bottom portion for enabling the infant bed to move from a first position to a second position along a length of the bed frame, wherein the bottom portion of the infant bed includes a first channel and in which a portion of the bracket mechanism can reciprocate.

2. The infant bed according to claim 1, wherein the coupling mechanism includes at least one mounting rod extending from the bottom portion of the infant bed.

3. The infant bed according to claim 2, wherein the at least one rod is insertable within a corresponding structural member secured to the bed frame.

4. The infant bed according to claim 1, further including a locking mechanism for locking a longitudinal position of the infant bed in relation to the bed frame.

5. The infant bed according to claim 1, wherein the bracket mechanism includes a track-rail slider assembly.

6. The infant bed according to claim 1, wherein the bottom portion of the infant bed frame includes opposed first and second channels and the bracket mechanism includes a first member slidably disposed in the first channel and a second member slidably disposed in the second channel.

7. An infant bed assembly, comprising:

a bed frame; and an infant bed slidably coupled to the bed frame such that the infant bed can be moved from a first position to a second position along a length of the bed frame, wherein the infant bed includes a bottom portion;

a top portion disposed over the bottom portion having upwardly extending barriers to form an interior region for confining an infant; and a coupling mechanism affixed to the bottom portion for securing the infant bed to the bed frame; and a slidable bracket mechanism coupled to the bottom portion for allowing the infant bed to move from a first position to a second position along a length of the bed frame, wherein the bottom portion of the infant bed includes a first channel and in which a portion of bracket mechanism can reciprocate.

8. The assembly according to claim 7, wherein the coupling mechanism includes a mounting rod rigidly extending from the bottom portion of the infant bed.

9. The assembly according to claim 8, wherein the bed frame includes a structural member for receiving the mounting rod.

10. The assembly according to claim 9, further including a locking mechanism for securing the infant bed in place.

11. The assembly according to claim 7, wherein the bracket mechanism includes a track-rail slider assembly.

* * * * *

UNITED STATES PATENT AND TRADEMARK OFFICE

CERTIFICATE OF CORRECTION

PATENT NO. : 6,546,575 B2
DATED : April 15, 2003
INVENTOR(S) : Ilene DeAngelo

It is certified that error appears in the above-identified patent and that said Letters Patent is hereby corrected as shown below:

Column 1,
Line 38, delete “bed scan be” and replace with -- bed can be --.

Column 3,
Lines 8 and 9, delete “bidirectional arrow 110” and replace with -- bi-directional arrow 101 --.

Column 4,
Line 1, delete “FIG. 6-7” and replace with -- FIGs. 6-7 --.

Column 6,
Line 6, delete “of bracket” and replace with -- of the bracket --.

Signed and Sealed this

Twenty-ninth Day of July, 2003

JAMES E. ROGAN
*Director of the United States Patent and Trademark Office*